US005125343A

United States Patent [19]

Domen et al.

[11] Patent Number: 5,125,343

[45] Date of Patent: Jun. 30, 1992

[54] FLUID DECELERATOR FOR HIGH ENERGY PROJECTILES

[76] Inventors: John K. Domen, 95 Toby Dr., Succasunna, N.J. 07876; John W. Black, 2102 Tamarack Ct., Champaign, Ill. 61821

[21] Appl. No.: 736,272

[22] Filed: Jul. 22, 1991

[51] Int. Cl.[5] ..... F41A 35/00; G01L 5/14

[52] U.S. Cl. ..... 102/293; 73/167

[58] Field of Search ..... 89/36.02; 102/293; 73/167; 273/410

[56] References Cited

U.S. PATENT DOCUMENTS

| | | | |
|---|---|---|---|
| 2,356,992 | 8/1944 | Gilson | 73/167 |
| 2,813,422 | 11/1957 | Schuessler | 273/410 |
| 3,217,534 | 11/1965 | Bingham et al. | 73/167 |
| 3,678,745 | 7/1972 | Teng | 73/167 |
| 3,940,981 | 3/1976 | Coney et al. | 73/167 |

*Primary Examiner*—David H. Brown

[57] ABSTRACT

A decelerator device for stopping a high energy projectile, including an elongated tube of a predetermined length and having an inlet and a terminal end to define an axial path for the projectile. The device includes a piston for moving on the axial path and having a cone shaped leading edge. Further included is a fluid container for filling the tube with a fluid to be displaced by movement of the piston through the tube and for collecting the displaced fluid as it is displaced. Also included in the tube are a plurality of port like slots for displacing fluid from the tube radially as the projectile enters the tube. The ports located proximate the inlet portion of the tube are of larger area, and become progressively smaller toward the terminal end. At some distance from the terminal end the tube is sealed along the remaining portion of the axial path so that the fluid will be displaced annularly past the piston in the opposite direction of piston travel to further cause the piston to decelerate to a stop within the length of the axial path.

7 Claims, 1 Drawing Sheet

FLUID DECELERATOR FOR HIGH ENERGY PROJECTILES

The invention described herein may be made, used, or licensed by or for the Government for Governmental purposes without the payment to me of any royalties thereon or therefor.

FIELD OF THE INVENTION

The present invention relates to a device for decelerating high energy projectiles, and more particularly to a device for decelerating projectiles over a relatively short distance without damage to the projectile.

BACKGROUND OF THE INVENTION

The evaluation of propulsion systems and projectile velocity includes the need to decelerate projectiles in a safe manner and over a short distance without causing harm to the projectile or to the environment. One such method which has been used is to fire the projectile into a large quantity of water, somewhat like shooting a bullet into a barrel of water. Of course, the bullet is deformed when it strikes the water, and thus cannot be reused.

More sophisticated systems have been designed to capture larger projectiles, but it has been found that the apparatus needs to be extensive in size. Moreover, concern must be given to confining the water or other fluid to prevent causing hazardous working conditions. More importantly, a device for directing the projectile into the water or other fluid often causes damage to the projectile because of the impact of the projectile on water. Water is clearly the fluid of choice, due to its clarity, availability, and safety.

Nevertheless, water is relatively incompressible. This allows for hydraulic forces to assist in decelerating the projectile but also causes an initial impact to potentially damage the projectile, particularly at high energy levels of up to about 650,000 foot-pounds. To date, no satisfactory system has been designed which permits deceleration of such high energy projectiles without damage and great inconvenience.

In some instances, the operation of devices presently available causes such damage to the device due to the force of impact of the projectile on the fluid that no really meaningful data can be obtained. To date, no effective device has been proposed which can decelerate high energy projectiles in short distances which permit operation in normal or conventional sized rooms and buildings.

Accordingly, it is an object of this invention to provide a device for decelerating high energy projectiles with complete safety for the projectile and for the environment and workers in the area.

Another object of this invention is to provide a device for decelerating high energy projectiles which can operate in relatively short distances of no more than about 20 feet in length.

Still another object of this invention is to provide a device for decelerating high energy projectiles which can be used with water as the decelerating medium, where the water is contained in a closed system.

Other objects will appear hereinafter.

SUMMARY OF THE INVENTION

It has now been discovered that the above and other objects of the present invention may be accomplished in the following manner. Specifically, a new decelerator device for stopping a high energy projectile has been discovered.

The device includes an elongated tube of a predetermined length and has an inlet and a terminal end to define an axial path for a projectile. Also included is a projectile defining a piston for moving on the axial path. The leading end of the piston has a cone shaped leading edge.

The device of this invention also includes a fluid means for filling the tube with a fluid to be displaced by movement of the piston through the tube and for collecting the displaced fluid as it comes out of the tube in order to recycle the fluid.

The tube includes a plurality of port means for displacing fluid from the tube in a radial direction as the projectile enters the tube. The port means is located proximate the inlet portion of said tube so that the fluid is displaced as the projectile enters the tube. The tube is sealed along the remaining portion of the axial path to up to the terminal end of the tube. This requires that the fluid be displaced annularly past the piston in the opposite direction to the direction of piston travel to further cause the piston to decelerate and stop within the length of the axial path.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
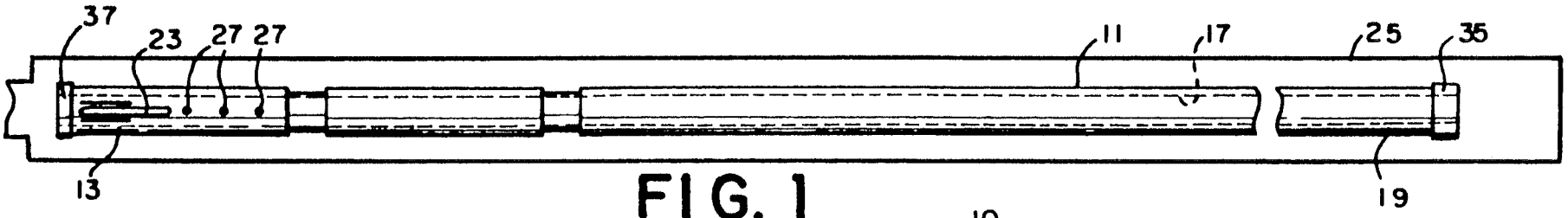
FIG. 1 is a side elevational view of the device of this invention.

The device of this invention is shown generally in FIG. 1 by the reference numeral 10. The device for decelerating high energy projectiles includes a tube 11 which has a substantial but convenient length of about 25 feet. The tube has an outside diameter in this embodiment of about 5.25 inches, and is formed from steel such as AISI 4140 steel.

Tube 11 has an inlet end 13 in which a high energy projectile 15 enters and travels along a path 17 to a closed terminal end 19. The projectile enters inlet 13 at a high velocity, having energy up to 650,000 foot-pounds or more. Tube 11 is placed in a tank which holds a fluid such as water, which is the preferred fluid. When the projectile 15 is fired, it enters inlet 13 and decelerates along path 17 and comes to rest before projectile 15 reaches end 19.

Figure 4:
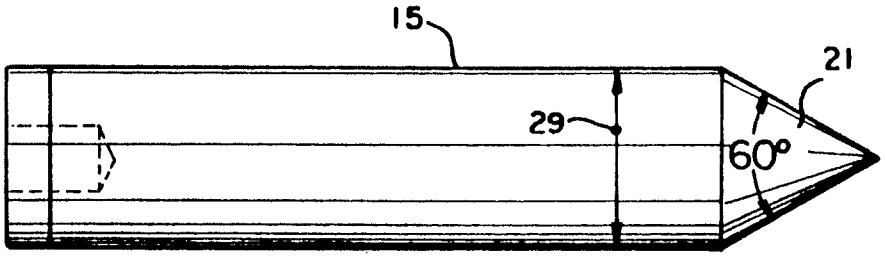
FIG. 4 is an enlarged side elevational view of the projectile used with the tube shown in FIG. 1.

Turning to FIG. 4, the projectile 15 is formed from steel and has a sharp nose 21 which is formed into a cone or other angled projection in order to function as a leading edge of the projectile as it enters and passes through the water or other fluid on path 17. Cone 21 presents a uniform angle of deflection for the fluid in the path 17.

Located at the inlet end 13 are a plurality of slots 23 which are provided to allow rapid motion of the water into the surrounding tank 25. The entire tube 11 has been immersed in water. As projectile 15 progresses along path 17, a systematic series of ports 27 allow water to escape to additionally slow the projectile 15. Ports 27 are only placed along the front part of path 17, so that as the projectile 15 progresses, only a small annulus exists for water to escape. The annulus exists between the outside diameter 29 of projectile 15 and the inside diameter 31 of tube 11, and allows water to escape backward over projectile 15 in the reverse direction along path 17.

Figure 5:
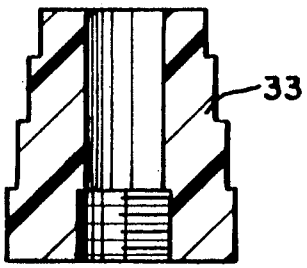
FIG. 5 is an enlarged side elevational view of an embodiment for use with the terminal end of the tube shown in FIG. 1.
Figure 2:
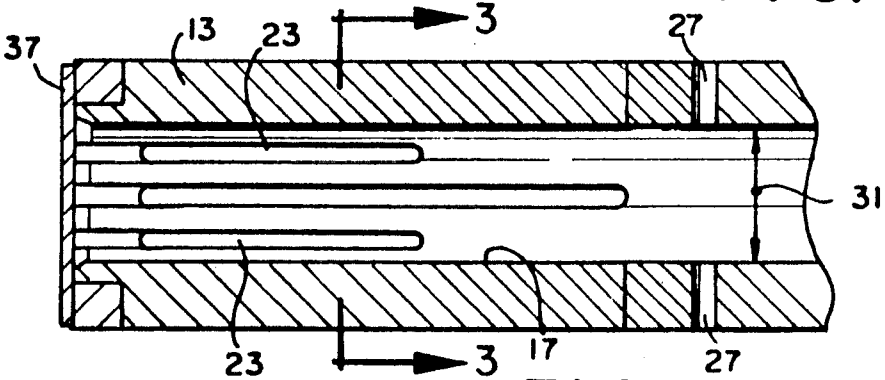
FIG. 2 is an enlarged view of the inlet end of the device shown in FIG. 1.

At the terminal end 19 of tube 11, a plastic shock damper 33, shown in FIG. 5, is placed to assist in breaking up the arriving shock wave. Damper 33 is made of polytetrafluoroethylene or nylon/polyester and is replaceable. It has a stepped cross section in order to better absorb the shock waves. After a number of firings, damper 33 becomes eroded as it absorbs the shockwaves and it can easily be replaced.

Terminal end 19 also has a breech 35 which is threaded on to end 19 and functions as a removable breech or cap. Unscrewing breech 35 permits removal of projectile 15 for refiring.

As can be seen, the device for decelerating high energy projectiles of this invention is safe, easy to use, and is completely enclosed. It is economical to operate and no external splashing occurs.

Figure 3:
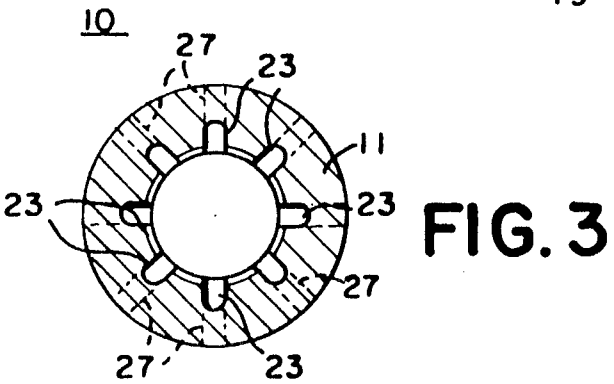
FIG. 3 is a sectioned view taken along the line 3—3 of FIG. 2.

At the inlet end 13 of tube 11, a plastic diaphragm 37 is placed to enclose the water that has been pumped into tube 11. The sharp nose cone 21 of projectile 15 penetrates diaphragm 37 effortlessly and begins to encounter the water in inlet 13 of tube 11. The shape of cone 21 deflects water and the initial water-hammer effect is greatly reduced by allowing water initially impacted to escape easily through slots 23. The cone 21 presents a uniform angle of deflection for the water and helps to deflect the water out through slots 23 because of the geometric configuration. The series of ports 27 are designed to dissipate projectile energy by transferring energy into water squirted radially and simultaneously keeping peak water pressure as low as possible. The relationship between slots 23 and ports 27 can be seen in FIG. 3.

Finally water becomes compressed, by perhaps up to 10 percent, in the final terminal end zone 19 where there are no ports and where water flows in the reverse direction in the annulus between the projectile outside diameter 29 and the inside diameter 31 of tube 11. This compression and reverse flow provides the final stopping force and the projectile comes to rest near but not at the terminal end 19 of path 17.

It is possible to calculate and compute the motion of the projectile 15 in tube 11. To demonstrate the reliability of the present invention, a Fortran computer program was written which included the complete geometry of the decelerator tube, with multiple slots and ports. Using equations for Bernoulli flow through orifices and an annulus, the compressibility and dynamic pressure of the water in the tube and the coupled equation of motion of the decelerating projectile, it was possible to predict the stopping point of a projectile.

Tests were run using the device of this invention. Operation for more than 800 times resulted in complete success of the device. The only parts that needed replacement were the plastic diaphragm 37 for each firing and the bumper (damper 33) after it began to show wear from absorbing shock waves.

While particular embodiments of the present invention have been illustrated and described, it is not intended to limit the invention, except as defined by the following claims.

We claim:

1. A decelerator device for rapidly stopping the motion of a high energy projectile having an essentially cone-shaped front end, in a relatively short distance without substantially deforming said projectile, said decelerator device comprising:

an elongated tube of a predetermined length and having an inlet and a terminal end to define an axial path for said projectile; said tube containing a fluid which is displaced by movement of the projectile through the tube; said tube including a plurality of port means for releasing some of said fluid from said tube radially as said projectile enters said tube and displaces said fluid, said port means being located proximate the inlet portion of said tube, said tube further being sealed along the remaining portion of said axial path to said terminal end for additionally causing fluid to be displaced annularly past said projectile causing drag forces on said projectile in the opposite direction of travel of said projectile to further cause said projectile to decelerate and to reach a stopped position within the length of said axial path.

2. The device of claim 1 further comprising a plastic diaphragm means which encloses the inlet end of said tube, said diaphragm means being broken by entry of said projectile into the tube.

3. The device of claim 2 wherein said fluid is water.

4. The device of claim 3 wherein said tube further comprises a plastic shock damper means in said tube's terminal end, said damper means aiding in breaking up shock waves propagated by said projectile.

5. The device of claim 4 wherein said terminal end of said tube includes removable breech cap means for removing a decelerated projectile for reuse.

6. The device of claim 5 wherein said path is no more than about 20 feet in length.

7. The device of claim 6 wherein the cone of said projectile front end has an apex angle of about 60°.

* * * * *